United States Patent [19]

Gabriel et al.

[11] Patent Number: 4,753,295

[45] Date of Patent: Jun. 28, 1988

[54] METHOD FOR PLACING BALL SEALERS ONTO CASING PERFORATIONS IN A DEVIATED PORTION OF A WELLBORE

[75] Inventors: Gerard A. Gabriel, Houston; Steven R. Erbstoesser, Missouri City, both of Tex.

[73] Assignee: Exxon Production Research Company, Houston, Tex.

[21] Appl. No.: 52,118

[22] Filed: Apr. 30, 1987

Related U.S. Application Data

[63] Continuation of Ser. No. 672,978, Nov. 19, 1984, abandoned.

[51] Int. Cl.[4] ..... E21B 33/13

[52] U.S. Cl. ..... 166/284; 166/281

[58] Field of Search ..... 166/250, 281, 284

[56] References Cited

U.S. PATENT DOCUMENTS

| | | | |
|---|---|---|---|
| 3,028,914 | 4/1962 | Flickinger | 166/284 |
| 4,102,401 | 7/1978 | Erbstoesser | 166/284 |
| 4,139,060 | 2/1979 | Muecke et al. | 166/281 |
| 4,160,482 | 7/1979 | Erbstoesser et al. | 166/284 |
| 4,187,909 | 2/1980 | Erbstoesser | 166/284 |
| 4,194,561 | 3/1980 | Stokley et al. | 166/162 |
| 4,195,690 | 4/1980 | Erbstoesser et al. | 166/281 |
| 4,287,952 | 8/1981 | Erbstoesser | 166/284 |
| 4,407,368 | 10/1983 | Erbstoesser | 166/284 |
| 4,421,167 | 12/1983 | Erbstoesser et al. | 166/255 |
| 4,488,599 | 12/1984 | Graham et al. | 166/284 |

OTHER PUBLICATIONS

"The Design of Buoyant Ball Sealer Treatments", by G. A. Gabriel and S. R. Erbstoesser, SPE Paper No. 13085; SPE Conference, Sep. 16–19, 1984.

*Primary Examiner*—Jerome Massie
*Assistant Examiner*—Bruce M. Kisliuk
*Attorney, Agent, or Firm*—Marc L. Delflache; Hubert E. Cox; Gary D. Lawson

[57] ABSTRACT

An improved method for placing ball sealers (25) onto casing perforations (17) in a deviated wellbore (10) is disclosed. In this invention, a plurality of ball sealers (25) are introduced into the casing and are transported to the perforations at an interface (26) between two immiscible fluids; the first or leading fluid (21) having a density greater than the ball sealers and the second or trailing fluid (24) having a density greater than the ball sealers.

17 Claims, 3 Drawing Sheets

FIG. 3
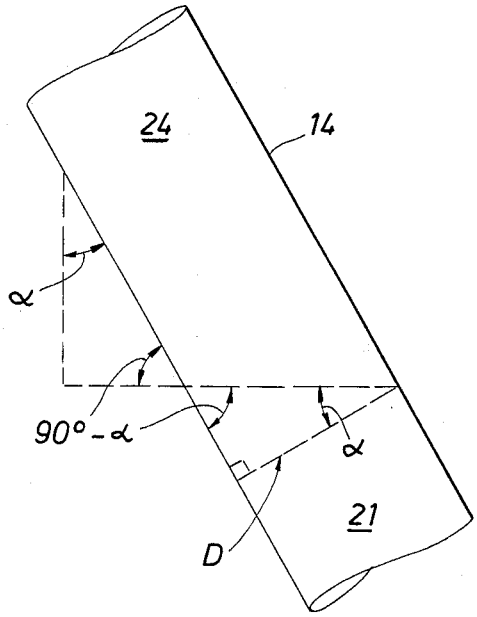
FIG. 4
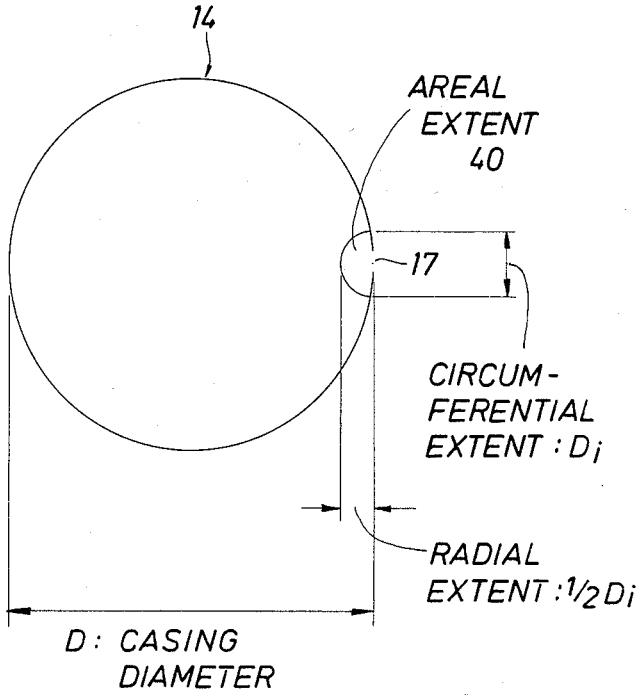
FIG. 5
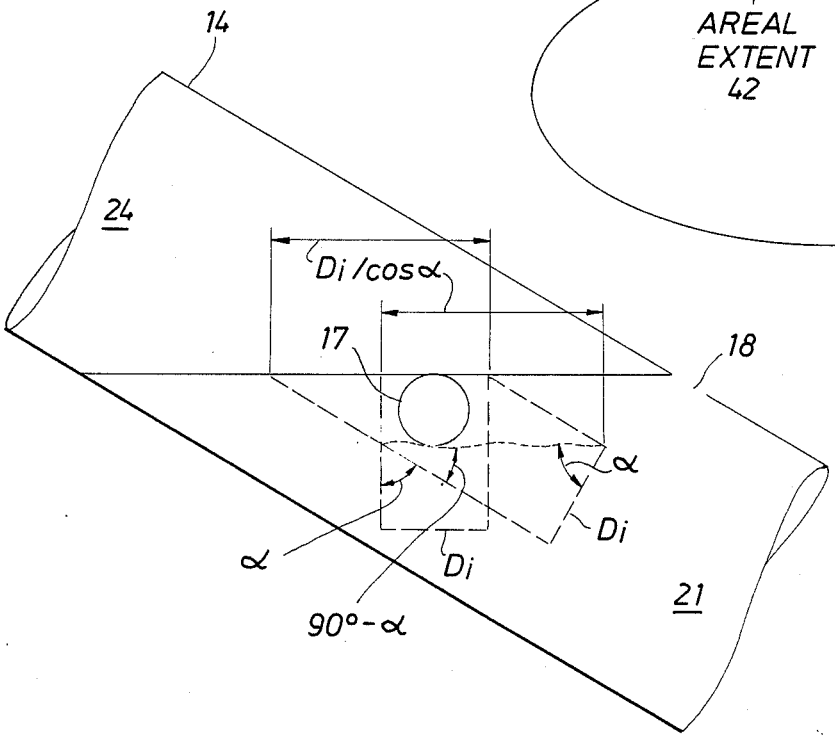
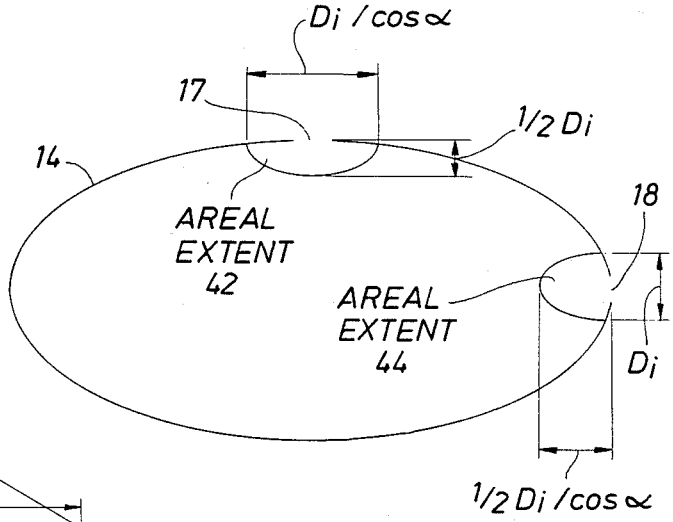
FIG. 6

METHOD FOR PLACING BALL SEALERS ONTO CASING PERFORATIONS IN A DEVIATED PORTION OF A WELLBORE

This application is a continuation application of copending application Ser. No. 672,978, filed on Nov. 19, 1984, now abandoned.

BACKGROUND OF THE INVENTION

1. Field of the Invention

This invention pertains to the treating of wells and, more particularly, to a method for selectively restricting the flow of fluids through perforations in a deviated oil well casing by small balls or spheres of appropriate size.

2. Description of the Prior Art

It is common practice in drilling oil and gas wells to deviate the wellbore from the vertical. When the wellbore is intentionally deviated from the vertical, it is called directional drilling. Directional drilling has application in several situations such as producing from inaccessible locations (i.e. populated areas, hostile environments, under rivers, etc.), drilling from offshore platforms, and sidetracking a vertical wellbore after the original well was drilled into water-bearing formations or after downhole problems require abandonment of the lower portion of the wellbore.

It is common practice in completing oil and gas wells, including deviated wells, to set a string of pipe, known as casing, in the well and to pump cement around the outside of the casing to isolate the various formations penetrated by the well. To establish fluid communication between the hydrocarbon-bearing formations and the interior of the casing, the casing and cement sheath are perforated.

At various times during the life of the well, it may be desirable to increase the production rate of hydrocarbons by acid treatment or hydraulic fracturing. If only a short, single, hydrocarbon-bearing zone in the well has been perforated, the treating fluid will flow into this productive zone. As the length of the perforated zone or the number of perforated zones increases, treatment of the entire productive zone or zones becomes more difficult. For instance, the strata having the highest permeability will most likely consume the major portion of a given stimulation treatment leaving the least permeable strata virtually untreated. Therefore, techniques have been developed to divert the treating fluid from the high permeability or undamaged zones to the low permeability or damaged zones.

Various mechanical techniques for selectively treating multiple zones have been suggested including techniques using, for example, packers, baffles and balls, bridge plugs, and ball sealers.

Packers have been used extensively for separating zones for treatment. Although these devices are effective, they are expensive to use because of the associated workover equipment required for the tubing-packer manipulations. Moreover, mechanical reliability tends to decrease as the depth or deviation of the well increases.

In using baffles and balls to separate zones, a baffle ring, which has a slightly smaller inside diameter than the casing, fits between two joints of casing so that a large ball, or bomb, dropped in the casing will seat in the baffle. After the ball is seated in the baffle, the ball prevents further fluid flow down the hole. One disadvantage of this method is that the baffles must be run with the casing string. Moreover, if two or more baffles are used, the inside diameter of the bottom baffle may be so small that a standard perforating gun cannot be used to perforate below the bottom baffle.

A bridge plug, which is comprised principally of slips, a plug mandrel, and a rubber sealing element, has been run and set in casing to isolate a lower zone while treating an upper section. After fracturing or acidizing the well, the plug is generally retrieved, drilled, or knocked to the well bottom with a chisel baller or drill-pipe. One difficulty with the bridge plug method is that the plug sometimes does not withstand high differential pressures. Another problem with this technique is that the placement and removal of the plug can be expensive due to rig costs and associated equipment.

One of the more popular and widely used diverting techniques uses ball sealers. In a typical method, ball sealers are pumped into the well along with the formation treating fluid. The balls are carried down the wellbore and to the perforations by the fluid flow through the perforations. The balls seat upon the perforations and are held there by the pressure differential across the perforations.

Although ball sealer diverting techniques have set with considerable usage, the balls often do not perform effectively because only a fraction of the balls injected actually seat on perforations. Ball sealers having a density greater than the treating fluid will often yield a low and unpredictable seating efficiency, highly dependent on the difference in density between the ball sealers and the fluid, the fluid viscosity, the flow rate of the fluid through the perforations, and the number, spacing and orientation of the perforations. The net result is that the plugging of the desired number of perforations at the proper time during the treatment to effect the desired diversion is left virtually to chance.

Lightweight ball sealers are ball sealers having a density less than the treating fluid density and have been successfully used to improve seating efficiency. The treating fluid containing lightweight ball sealers is injected down the well at a rate such that the downward velocity of the fluid is sufficient to impart a downward drag force on the ball sealers greater in magnitude than the upward buoyancy force of the ball sealers. Once the ball sealers have reached the perforations, all will seat and plug the perforations provided fewer balls are injected than there are perforations accepting fluid, thereby forcing the treating fluid to be diverted to the remaining open perforations. Although these lightweight ball sealers can be highly effective in improving diversion, one problem with using these ball sealers occurs when the downward flow of fluid in the casing is so slow that the drag forces exerted on the balls by the treating fluid may not overcome the upward buoyancy force of the ball sealers and thus the ball sealers may not be transported to the perforations. This problem is generally experienced during treatments pumped at low rates and in particular matrix treatments such as matrix acidizing.

One prior method of selective diversion is disclosed in U.S. Pat. No. 4,194,561. This method involves the use of placement devices for positioning buoyant ball sealers at a specific location within the wellbore. These devices are equipped with means to prevent the upward migration of the buoynat ball sealers past the placement device. The ball sealers are seated on the perforations by flowing fluid down the casing and through the device. These devices are normally used to selectively close the perforations located at the lowermost region of the casing.

Another prior art method for selective diversion is disclosed in U.S. Pat. No. 4,287,952. This method involves the selective sealing of perforations at the top or bottom of the deviated casing (wherein "top" and "bottom" are identified with reference to an imaginary plane which is aligned substantially vertically and extends along the longitudinal axis of the casing). Other perforations are formed away from these top and bottom perforations thereby permitting balls of particular densities to seat on such top or bottom perforations, leaving the other perforations placed away from these top and bottom perforations open for fluid communication with a zone to be treated.

Yet another prior art method of placing ball sealers onto a casing perforation is disclosed in U.S. Pat. No. 4,195,690. This method involves the placement of a plurality of balls at a transition region between a first and second fluid. This method has application in a deviated wellbore also as a means of negating the effects of gravity/buoyancy forces which limit the seating capabilities of buoyant and nonbuoyant ball sealers to those perforations preferentially located on the high and low side of the pipe, respectively. However, U.S. Pat. No. 4,195,690 does not teach the number of ball sealers to be used in sealing at least one perforation in a deviated wellbore if the balls are transported down at an interface between two immiscible fluids.

Therefore, there still exists a need for an improved method of treating a specific zone in a deviated casing without the need to be concerned about the circumferential location of the perforations around the casing or about the use of a placement apparatus but, rather, based on more proven diversion techniques using lightweight ball sealers.

SUMMARY OF THE INVENTION

The present invention is an improvement to the invention disclosed and claimed in U.S. Pat. No. 4,195,690, assigned to Exxon Production Research Company, which U.S. patent is hereby incorporated by reference and made a part of this Application.

Broadly, the present invention comprises transporting a plurality of ball sealers down a deviated casing at an interface formed by two immiscible fluids. The number of ball sealers is greater than the number of perforations desired to be sealed to the extent that the interface is maintained partially covered with ball sealers. The plurality of ball sealers is transported past the perforations such that at least one ball sealer seats onto a perforation. The leading or first fluid has a density greater than the ball sealers. The trailing or second fluid has a density less than the ball sealers and is immiscible in the first fluid. BRIEF DESCRIPTION OF THE DRAWINGS FIG. 1 is an illustrational view in section of a deviated well.

FIG. 3 is a schematic of a deviated well illustrating the geometry associated with the practice of the invention.

FIG. 4 is a schematic of a horizontal cross-section of a vertical well.

FIG. 5 is a schematic of the deviated well further illustrating the practice of the invention.

FIG. 6 is a schematic of a horizontal cross-section of the deviated well.

Figure 7:
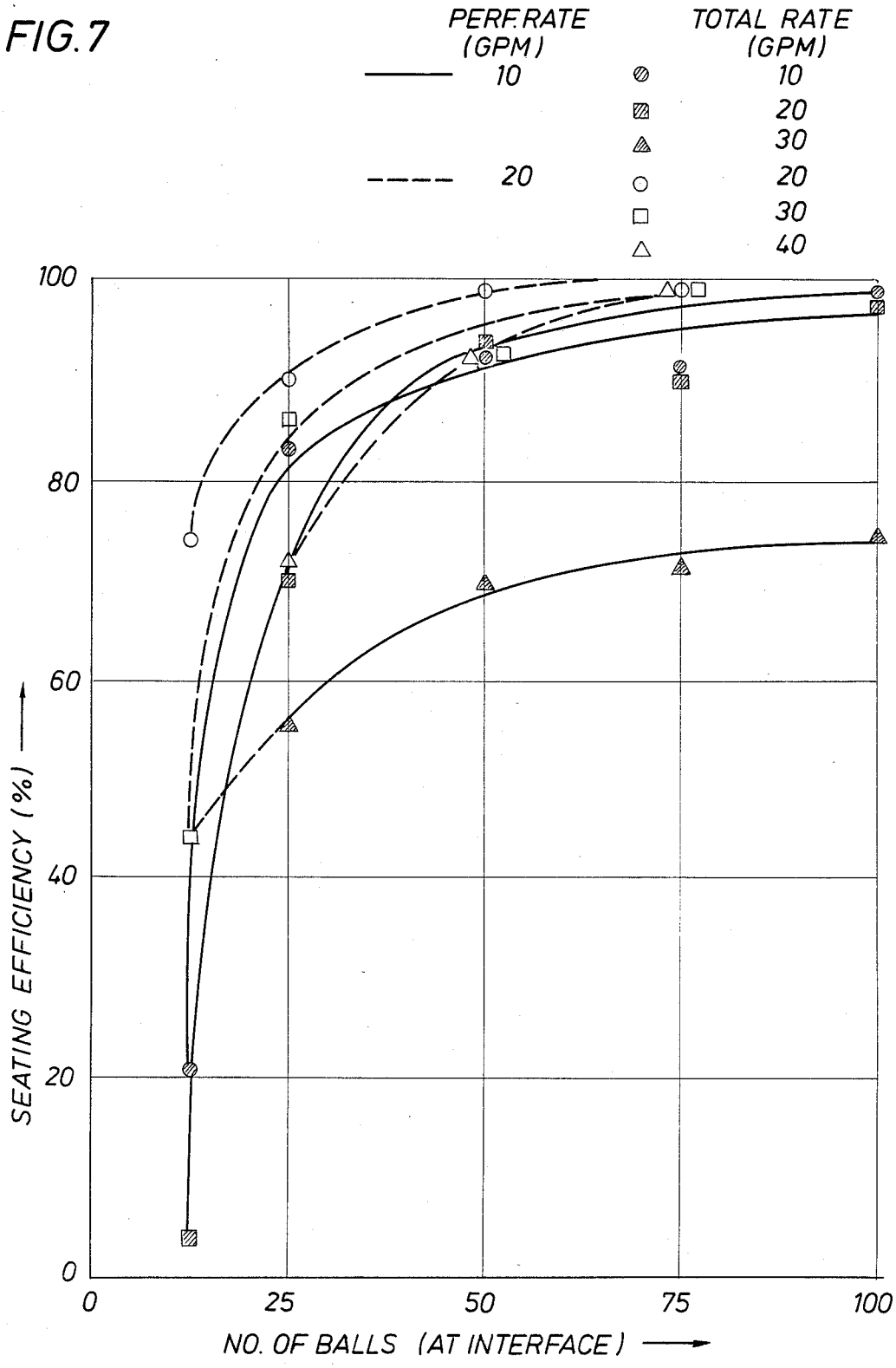

FIG. 7 is a graph of seating efficiency versus number of ball sealers at the interface. DETAIL DESCRIPTION OF THE INVENTION Referring to FIG. 1, there is shown a deviated wellbore 10 which penetrates an overburden 12 and a subterranean formation 13 containing petroleum, gas, and mixtures thereof. A well casing 14 extends through the well and is held in place by a cement sheath 15. To establish fluid communication between the formation and the interior of the casing, the casing and sheath are penetrated to provide a plurality of perforations 17. The well may be provided with a packer 18 to isolate production from formation 13 from the remainder of the string and with a tubing string 20 which extends from the wellhead at the surface (not shown) through packer 18. The tubing string is provided with a suitable flowline (not shown) for the introduction and withdrawal of fluids to and from the well.

If the well does not have the desired productivity, it is common practice to treat the well to improve its production characteristics. This may be accomplished by acidizing, hydraulic fracturing, or other methods which comprise pumping a treating material down the casing and into the producing formation through the perforations 17. As mentioned above, it is sometimes desirable to selectively close those perforations through which most fluid is flowing during the treating operation so that treating fluid is pumped into the formation adjacent to other perforations in the casing which are less permeable or damaged.

Prior to illustrating any specific embodiments of this invention, it is appropriate that the following definitions be established to clarify the terminology used to describe ball sealer and fluid density characteristics. Namely, light or low density fluids refer to fluids having densities less than the density of the ball sealer. Conversely, dense or heavy fluids herein refer to fluids having densities greater than the density of the ball sealer. Similarly, light, lightweight, or low density ball sealers refer to ball sealers having a density less than the densities of the wellbore fluids. Heavy or dense ball sealers refer to ball sealers having a density greater than the densities of the wellbore fluids.

By way of illustrating one embodiment of the present invention, it will be assumed that the well is an oil production well which is to be treated by a matrix acidizing operation to increase the permeability of formation 13 near the wellbore. It is to be understood, however, that the following description of such an acidizing operation is merely exemplary in that the invention may be used in other well-treating procedures, such as hydraulic fracturing or solvent/surfactant stimulation treatments.

The acidizing of formation 13 is accomplished by first pumping through production tubing 20 a dense fluid 21. Dense fluid 21 would be the treating fluid. After a suitable quantity of dense fluid is injected, lighweight ball sealers 25 are introduced in the last few barrels of dense fluid. Then a suitable quantity of a second light or low density fluid 24 is introduced. The light fluid is immiscible with the dense fluid. Since the ball sealers are heavier than the light fluid 24 and lighter than the dense fluid, the balls 25 will gravitate to the interface 26 between the bottom of the light fluid and the top of the dense fluid. Since both fluids are immiscible, the interface 26 is sharp and distinct. The use of such a sharp and distinct interface is important in the practice of the invention because it provides a plane or surface across which ball sealers can move in a direction normal to gravity. Since the interface is in intimate contact with the entire circumference of the interior of the casing, regardless of the angle of deviation of the casing or the wellbore, ball sealers are able to seal perforations located at any circumferential postition around the casing.

If the treating fluid is the dense fluid 21 which was first injected, it is preferred that after a sufficient amount of light fluid 24 has been introduced into the casing, a displacement fluid 29 is injected into the casing to completely displace the previously injected fluids. The displacement fluid may be a fluid denser than the ball sealers which could be another treating fluid.

Referring to FIGS. 1 and 2 again, typically the dense fluid 21 is introduced into the well ahead of the light fluid and may be referred to as the leading fluid. Similarly, the light fluid 24 may be referred to as the trailing fluid.

Included in these two classes of fluids (i.e. dense fluids and light fluids) are any fluids with the requisite density characteristics. Suitable dense fluids may include acid solutions such as hydrochloric acid, hydrofluoric acid, formic acid, salt-weighted acid solutions, salt-weighted water solutions, and freshwater, as well as suitable dense hydraulic fracturing fluids and solvent-/surfactant solutions used to stimulate the formation. Suitable light fluids include field crudes, diesel oil, aromatic solvents, light hydrocarbon condensates, low salinity brines, and fresh water.

The volume of light fluid 24 introduced in the casing will vary depending on whether the light fluid is for placement of the balls only or for treatment of the formation also. At a minimum, the volume of light fluid must be sufficient to permit the interface to traverse the desired length of perforated interval before being underrun by a second stage of dense fluid. This minimum volume is a function of the relative densities of the light and heavy fluids, the tubing-casing geometry, the well deviation, the depth and extent of the perforated interval desired to be sealed, and the pumping rate.

In practicing the invention, a minimum number of ball sealers 25 should be introduced into the casing 14 to ensure proper seating in the deviated wellbore and treatment of the formation 13. The seating efficiency can be maximized by minimizing the distance that a ball sealer must travel across the interface. The proximity of a ball sealer to a perforation is controlled by the number of ball sealers at the immiscible interface.

The appropriate number of ball sealers must be injected in a volume of fluid at the end of the dense fluid stage and/or the beginning of the light fluid stage that is less than or equal to the migration volume of the ball sealers from the surface to the location in the perforated interval desired to be sealed. This will insure that the ball sealers are at the interface when it traverses the location in the perforated interval desired to be sealed.

Figure 1:
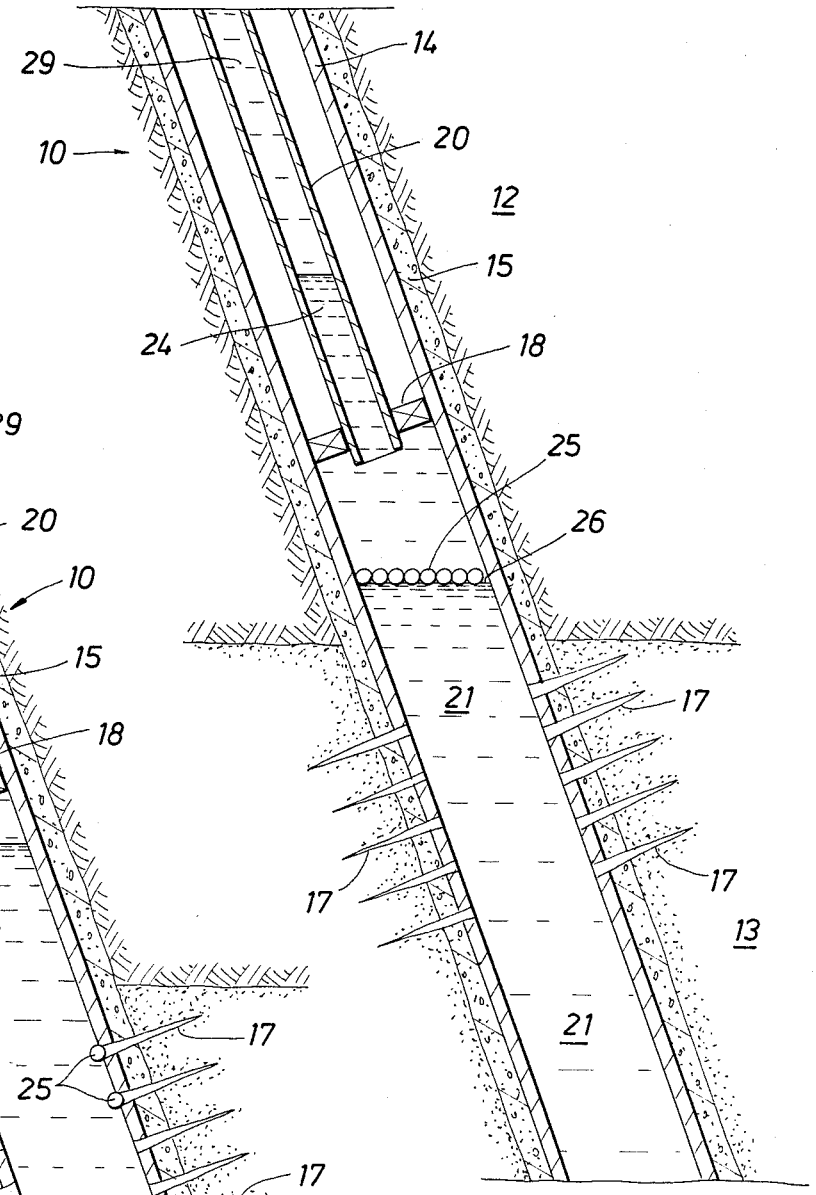
Figure 2:
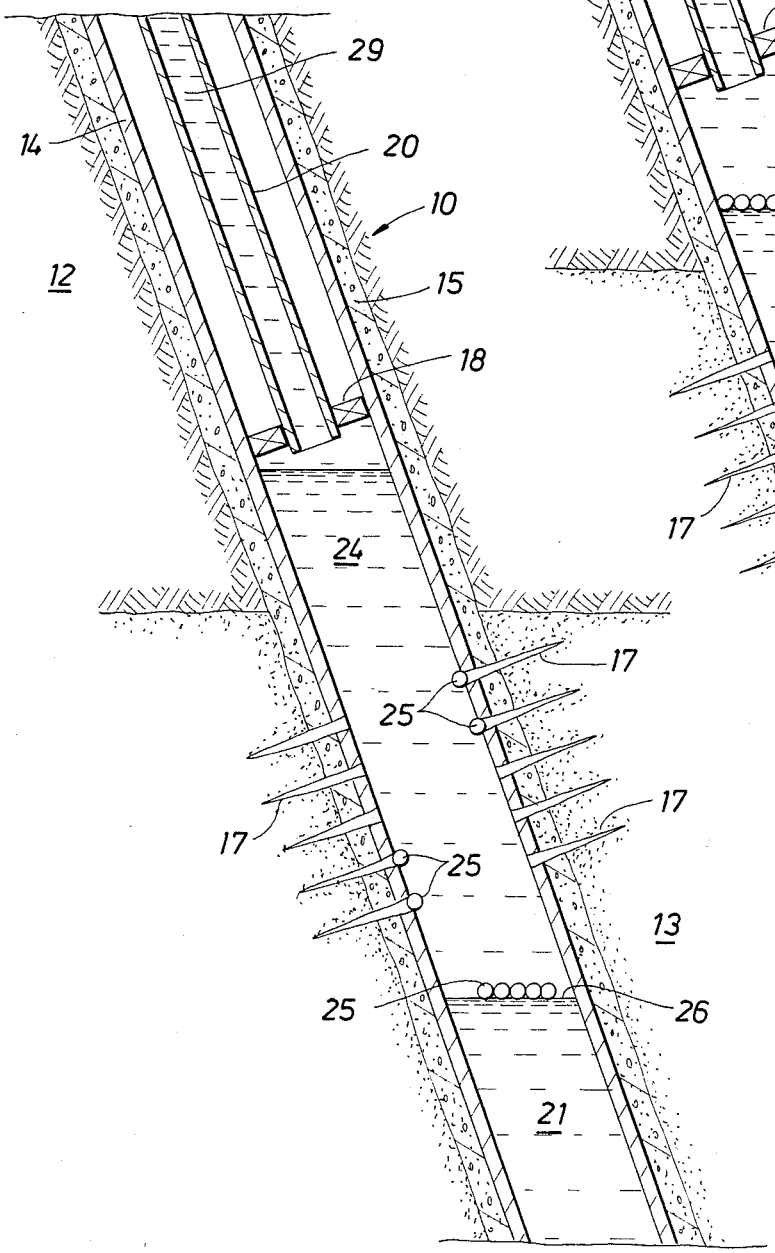
FIG. 2 is an illustrational view in section of the same deviated well as illustrated in FIG. 1 but further illustrating the practice of the invention.

A broader perspective of the invention may be gained by comparing previously discussed FIG. 1 with FIG. 2. FIG. 2 illustrates the invention as the interface 26 advances past the perforations 17. As shown, some of the ball sealers 25 remain suspended at the interface while the remaining ball sealers have seated on perforations adjacent the more permeable or undamaged portions of the formation 13. Light fluid 24 and then displacement fluid 29 are being injected into the formation through perforations not sealed.

The embodiment described above may be repeated to carry out multistage treatments of the formation. For example, the process may be repeated by using a second stage of treating fluid as the displacement fluid 29. In this case, the treating fluid would be followed by light fluids again.

After a suitable number of treatment stages have been injected into the formation, fluid injection may be stopped to permit pressure in the well to decrease. The ball sealers which unseat from perforations will tend to gravitate to the bottom of the light fluid and thus be less likely to be produced from the well during production, particularly if the production fluids are low density fluids.

The ball sealers used in the practice of the invention would have a density between the light fluid 24 and the dense fluid 21. Ball sealers suitable for this invention may have an outer covering sufficiently compliant to conform to the perforations and have a solid rigid core which resists extrusion into or through the perforations (see, for example, U.S. Pat. Nos. 4,102,401 and 4,244,425). The ball sealers are approximately spherical in shape but other geometries may be used. The density differential between the light and heavy fluids and the ball sealers is preferably sufficient to allow the ball sealers to gravitate to the bottom of the light fluid and/or to the top of the heavy fluid as the fluids flow downwardly in the casing. In a typical matrix treating process, the density differential between the light fluid and the ball sealers is preferably about 0.03 g/cc or more at bottom-hole conditions. Similarly, the density differential between the dense fluid and the ball sealers is preferably aobut 0.03 g/cc or more at bottom-hole conditions. For example, if the density of ball sealers is 1.00 g/cc, the dense fluid should have a density of at least 1.03 g/cc and the light fluid should have a density less than 0.97 g/cc at bottom-hole conditions. To achieve this controlled-density situation, the ball sealers may be constructed specifically to yield the appropriate densities.

As noted above with reference to FIG. 2, the invention is performed by advancing the interface 26 downwardly past the perforations 17. In practicing the invention, a minimum number of ball sealers must be injected into the deviated wellbore to ensure that at least one perforation is sealed.

The minimum number of ball sealers needed to seal at least one perforation is related to the percentage of the total interfacial area occupied by a perforation's area of influence. Laboratory data, as discussed below, indicate that both the total interfacial area and a perforation's area of influence increase by the same factor as the angle of the wellbore from the vertical increases. Therefore, the minimum number of ball sealers required to seal at least one perforation is not a function of the deviated angle of the wellbore; rather, it has been found to be a function of the inside diameter of the casing. The minimum number of ball sealers needed to seal at least one perforation can be approximated by the following empirical equation:

$$\text{Minimum Number of Ball Sealers } (N_{min}) \sim D^2/2.4 \quad (1)$$

where D is the inner diameter of the casing (in inches).

In other terms, to obtain high seating efficiency, which is desirable, a minimum number of ball sealers should be injected which number can be expressed also in terms of the minumum percent coverage of the interface (i.e., fraction of interface covered with one layer of ball sealers—referred to also as a "monolayer"). The minimum interfacial coverage required can be approximated by the following equation:

$$\text{Minimum Percent of Interfacial Coverage} \sim \frac{(D_b)^2\cos\alpha}{(1-\phi)2.4} \times 100 \quad (2)$$

where $D_b$ is the diameter of the ball sealer (in inches), $\alpha$ is the angle of the wellbore from the vertical, and $\phi$ is the packing porosity of the ball sealers at the interface.

Reference is made to FIGS. 3–7 for an explanation of these two equations.

When $\alpha$ is equal to 0°, the casing 14 is vertical and the horizontal cross-sectional interfacial area is a circle whose area is $\pi D^2/4$ (see FIG. 4). When $\alpha$ is between 0° and 90° (see FIG. 3) the horizontal cross-sectional interfacial area is an ellipse whose area is $\pi ab$, where 2a is the major axis ($D/\cos\alpha$) and 2b is the minor axis (D). Therefore, the elliptical area is defined to be:

$$\text{Interfacial elliptical area} = \frac{\pi D^2}{4\cos\alpha} \quad (3)$$

Thus, the number of balls to form a complete monolayer at the interface may be approximated as:

$$\text{(No. of Interfacial Ball Sealers)Monolayer} = \frac{(1-\phi)(\pi/4)(D^2/\cos\alpha)}{\pi/4(D_b)^2} \quad (4)$$

where $D_b$ is the diameter of the ball sealer (in inches), and $\phi$ is the porosity. For $\phi=0.30$ (empirical) and $D_b=\frac{7}{8}$ inches, equation (4) reduces to:

$$\text{(No. of interfacial Ball Sealers)Monolayer} = \left(\frac{0.70}{\cos\alpha}\right)\left(\frac{8D}{7}\right)^2 = \frac{0.91D^2}{\cos\alpha} \quad (5)$$

Referring to FIG. 4, a perforation 17 is indicated on the circumference of casing 14. FIG. 4 is a horizontal cross-section taken across a vertical wellbore. Adjacent to perforation 17 is a semi-circular area identified as areal extent 40. This defines the area of influence ("capture influence") that the perforation will affect as the interface traverses the perforation. The circumferential component on casing 14 of the capture influence of areal extent 40 is identified as $D_i$. The radial component on casing 14 of the capture influence of areal extent 40 is $\frac{1}{2}D_i$.

Referring now to FIGS. 5 and 6, the casing 14 is shown deviated. In FIG. 5 a perforation 17 is located along the major axis of the resulting elliptical horizontal cross-sectional area (see FIG. 6). Another perforation 18 is located along the minor axis of the resulting elliptical horizontal cross-sectional area shown in FIG. 6.

The circumferentail components on casing 14 of the capture influence of perforations 17 and 18 depends on their location on the ellipse. In the case of the perforation 17 in FIGS. 5 and 6, the circumferentail component of the capture influence of areal extent 42 is equal to $D_i/\cos\alpha$, where $\alpha$ is the angle of the wellbore in degrees with respect to the vertical. The circumferential component of the capture influence of areal extent 44 is equal to $D_i$, which is similar to the circumferential component of the capture influence of areal extent 40 shown in FIG. 4. The radial component of the capture influence of areal extent 42 is equal to $D_i/2$. The radial component of the capture influence of areal extent 44 is equal to $(\frac{1}{2})(D_i/\cos\alpha)$.

In order for a ball sealer to seat on a perforation, it must be within the capture influence of the particular areal extent. Accordingly, the size of the capture influence for areal extent 40 shown in FIG. 4 is approximately equal to $\pi D_i^2/8$. The size of the capture influence for areal extent 44 as shown in FIG. 6 is approximately equal to $[(\pi D_i^2/8)]/\cos\alpha$. Since the area of the circle shown in FIG. 4 is $\pi D^2/4$ and the area of the ellipse shown in FIG. 6 is $[(\pi D^2/4)]/\cos\alpha$, the ratio of the areas of capture influence to the areas of the interior of the casing in FIGS. 4 and 6 is approximately equal to:

$$\frac{A_{influence}}{A_{casing}} \sim \left(\frac{\frac{1}{2}D_i^2}{D^2}\right)_{circle} \sim \left(\frac{\frac{1}{2}D_i^2}{D^2}\right)_{ellipse}$$

Thus, in solving these two equations $$A_{influence}/A_{casing} \sim F/D^2 \text{ where } F \sim D_i^2/2.$$

F has been determined empirically by laboratory data. The results from the laboratory experiment, as discussed below, indicate that the factor F lies between about 1.8 and 2.4, preferably about 2.4.

From probability theory, the miminum number of ball sealers is directly related to the ratio of the $A_{casing}A_{influence}$. In other words, the minumum number of ball sealers is directly related to the percentage of the total area of the casing ($A_c$) which is occupied by the area of influence or areal extents ($A_i$). Consequently, $$\text{Minimum Number of Balls} = \frac{A_c}{A_i} \sim \frac{D^2}{F} \sim \frac{D^2}{2.4}$$

Referring back to equation (4) and converting the minimum number of balls to a percentage of interfacial coverage:

$$\text{Minimum Percent of Interfacial Coverage} \sim \frac{D^2/F}{\dfrac{(1-\phi)(\pi/4)(D^2/\cos\alpha)}{(\pi/4)(D_b)^2}} \times 100$$

This then reduces to equation (2) when F=2.4.

Laboratory Experiments

Laboratory experiments were conducted using a lucite wellbore model having an outside diameter of 7 inches and an inside diameter of 6 inches. Initially, the wellbore model was inclined at 60° to the vertical. This first experiment indicated that it was preferable that the interface be formed between two immiscible surfaces for optimum movement of the balls laterally along the interface towards the perforations. This first experiment also indicated that it was not necessary that there be a substantially complete monolayer of ball sealers at the interface following advancement past the perforations as originally contemplated. Subsequent experiments were conducted with the same model but inclined at 45° and 75° to better define the operating efficiency of the invention. The data for the 45° test are shown in FIG. 7. In all these tests, the first fluid was tap water (specific gravity of 1.0) and the second light fluid was a refined oil with mutual solvent (Isopar with 10%–20% C7610; specific gravity of 0.80–0.85). Consequently, a very distinguishable interface was formed. The balls were 0.875 inches in diameter and had a specific gravity of 0.90. The displacing fluid following the oil was tap water.

Referring to FIG. 7, the fluids were pumped into the lucite model at rates of 10, 20, 30 and 40 gallons per minute (gpm). Flow out the bottom of the model was controlled in order to obtain perforation flow rates of 10 or 20 gpm. The tests indicate that for an interior casing diameter of 6 inches, a minimum number of 15–20 balls is required in order to seal at least one perforation. This resulted in the factor F being between 1.8 and 2.4 since the minimum number of balls is inversely realated to the $A_{influence}/A_{casing}$. Thus, the minimum number of balls approximately equals $D^2/F$ or $F \sim D^2/N_{min}$, referring back to equation (1 ) above.

Referring to FIG. 7, it can be seen that the efficiency of the ball sealers increases significantly upon the introduction of at least 15–20 ball sealers. This number represents the general range of the minimum number of balls required to achieve a high seating efficiency.

A number of conclusions can be made based on the experiments. If the flow rate through the perforations is constant, seating efficiency will decrease as the flow rate past the perforations increases. If the flow rate past the perforations is constant, the seating efficiency will increase as the flow rate through the perforations increases. There is no statistically significant difference between data from the 45° and 75° tests. Consequently, only the 45° data are shown.

Field Example

The following field example illustrates a specific procedure for performing the present invention. For this hypothetical example, a well is drilled in an oil- and gas-bearing, carbonate formation. The well is deviated 30° from the vertical through the productive formation. It is completed, generally as shown in FIGS. 1 and 2, with a 7-in.-OD, 32-lb/ft production casing (6.094-in. ID) to a total measured depth of 5120 ft. A packer is run into the casing on 2⅞-in.-OD, 6.5-lb/ft production tubing (2.441-in. ID) and set at the 5000 ft depth. An interval located at the 5050–5100 ft level is perforated with 100 holes. The perforations are randomly oriented around the circumference of the production casing.

To stimulate oil production, the well is to be acidized with 28% hydrochloric acid (HCl) having an approximate density of 1.14 g/cm$^3$. The maximum allowable injection rate of the acid solution down the production tubing for matrix acidization is determined to be 2.0 barrels per minute (BPM). Injection rates above 2.0 BPM may fracture the formation.

Ball sealers having a ⅞-in. diameter and a density of 1.10 g/cm$^3$ are used to restrict fluid flow through the perforations having the least resistance to fluid flow. The rising velocity of the ball sealers in 28% HCl is determined to be approximately 30 ft/min. At 2 BPM, the downward velocity of the 28% HCl is about 345 ft/min in the production tubing and about 56 ft/min in the production casing. Consequently, the ball sealers could be transported down the production tubing and casing to the perforated interval. However, without using a treating technique as provided by this invention, these balls would only be effective in sealing perforations located on the high side of the wellbore.

The practice of this invention may be carried out in accordance with the following sequence of steps:

1. Inject a 1.20 g/cm$^3$ aqueous brine containing a NaCl—$CaCl_2$ mixture to fill the wellbore (optional);
2. Inject 100 barrels of the 28% HCl (1.14 g/cm$^3$) into the production tubing;
3. Inject 10 barrels of diesel oil having a density of 0.85 g/cm$^3$ and containing 65 ball sealers in the first 5 barrels of diesel oil;
4. Inject 100 barrels of 28% HCl into the production tubing;
5. Inject field crude oil into the tubing to displace the HCl to the perforations.

In practicing the above procedure, the ball sealers will sink in the diesel, but float in the 28% HCl. During Steps 3 and 4 the balls will migrate to and accumulate at the diesel-acid interface. The volume of diesel in Step 3 is sufficient to prevent the second stage of 28% HCl (Step 4) from falling completely through the diesel and reaching the stable, immiscible interface before the interface has traversed the perforated interval. The diesel volume is a function of completion geometry and injection rate (assumed to be 2.0 BPM in this example).

With reference to FIGS. 1 and 2, the 28% HCL injected in Step 2 is dense fluid 21; the diesel oil injected in Step 3 is light fluid 24; and the 28% HCL injected in Step 4 is displacement fluid 29. It will be obvious to anyone skilled-in-the-art based on this disclosure that Steps 2 and 3 above may be repeated several times in order to provide multiple applications of ball sealers.

In this hypothetical example, it is desired initially to treat half of the interval (i.e., 50 perforations), to subsequently seal the treated perforations, and finally to treat the remaining 50 perfortions. Therefore, the number of ball sealers (Step 3) is determined as the number of perforations desired to be sealed (50 in this example) plus the minimum number of balls that must be positioned at the interface to achieve high seating efficiency. In this example, the minimum number of ball sealers is 15:

$$(\text{Interface Balls})_{min} \sim \frac{[D(\text{in.})]^2}{2.4} \sim \frac{(6.094)^2}{2.4} \sim 15$$

The balls are injected in a volume of fluid (i.e., 5 barrels) at the beginning of the diesel stage that is less than the migration volume (at 2.0 BPM) of the ball sealers from the surface to the top of the perforated interval at 5,050 ft. This allows the balls to migrate to the interface. If equipment limitations preclude injecting ball sealers at the required rate (balls/min), the pump rate may be decreased or a shutdown period may be included in the program which provides additional time for the balls to migrate to the interface. However, a lower pumping rate necessitates a greater volume of diesel to prevent underrunning by the second stage of HCl.

The second stage of HCl (Step 4) treats the perforations that have not been sealed (i.e., 50 perforations).

The treatment is displaced with sufficient field crude to overdisplace all acid into the formation leaving the wellbore filled with the light field crude. As a result, upon completion of the above procedure, and upon relieving the differential pressure acorss the perforations, the ball sealers sink to the rathole. With the ball sealers in this location, the likelihood of producing ball sealers with the formation fluids is minimized.

Even though the invention has been disclosed in terms of producing an oil and gas well, it will be appreciated by those skilled in the art based on this disclosure that the invention may be used as described in a water-injection well that is adjacent to a producing well. A water-injection well is used to stimulate the reservoir and enhance production from the producing well. Such a water-injection well may be deviated and it may be desirable to seal only certain perforations using light-weight ball sealers and multiple density fluids as described herein.

Furthermore, while embodiments and applications of the method of the present invention have been shown and described, it will be apparent to those skilled in the art that many more modifications are possible without departing from the inventive concepts herein described. The invention, therefore, is not to be restricted except as is necessary by the prior art and by the spirit of the appended claims.

What is claimed is:

1. A method for plugging a known number of perforations in a well casing positioned in an intentionally deviated portion of a wellbore by means of a plurality of ball sealers, each sized to restrict flow through said perforations, said method comprising:

introducing into said casing a first fluid having a known density;

introducing into said casing a number of ball sealers, each having a density less than the density of said first fluid, with the proviso that the number of ball sealers introduced into the casing is greater than or equal to the number N which satisfies the following relationship:

$$N=P+D^2/2.4$$

where

P is the known number of said perforations to be plugged by said ball sealers, and D is a dimensionless number equivalent to the inner diameter of said casing in inches; and introducing into said casing a second fluid having a density less than the density of said ball sealers, said first and second fluids being immiscible and forming an interface between each other such that said ball sealers are transported down said casing at the interface between said first and second fluids and past said perforations to seal said known number of perforations.

2. The method according to claim 1, further comprising displacing said second fluid with a displacing fluid.

3. The method according to claim 2, wherein said displacing fluid is a formation treating fluid.

4. The method according to claims 1 or 2, wherein said first fluid is a formation treating fluid.

5. The method according to claim 4, wherein said displacing fluid is a formation treating fluid.

6. The method according to claims 1 or 2, wherein said second fluid is a formation treating fluid.

7. The method according to claim 6, wherein said displacing fluid is a formation treating fluid.

8. The method according to claim 1, wherein said first fluid has a density of at least 0.03 g/cc greater than the density of said ball sealers and said second fluid has a density at least 0.03 g/cc less than the density of said ball sealers.

9. The method according to claim 1, wherein said ball sealers are introduced concurrently with said first fluid.

10. The method according to claim 1, wherein said ball sealers and said second fluid are introduced into said casing concurrently.

11. The method according to claim 1, wherein said ball sealers are introduced into said casing concurrently with said first fluid and said second fluid.

12. The method according to claim 1, further comprising the additional steps of thereafter introducing a second plurality of ball sealers and additional said first fluid and additional said second fluid for subsequent applications of ball sealers.

13. The method according to claim 12, further comprising displacing the last introduction of additional said second fluid with a displacing fluid.

14. The method according to claims 12 or 13, wherein said first fluid is a formation treating fluid.

15. The method according to claim 13, wherein said displacing fluid is a formation treating fluid.

16. The method according to claims 12 or 13, wherein said second fluid is a formation treating fluid.

17. The method according to claim 16, wherein said displacing fluid is a formation treating fluid.

* * * * *